US005765766A

United States Patent [19]

Yoshida et al.

[11] Patent Number: 5,765,766

[45] Date of Patent: Jun. 16, 1998

[54] NOZZLE FOR JET MILL

[75] Inventors: Hideyuki Yoshida, Itami; Akihiro Nakamura, Osaka; Hiroshi Nakamura, Kobe; Masayuki Nakama, Itami; Masami Eda, Kobe, all of Japan

[73] Assignee: Minolta Co., Ltd., Osaka, Japan

[21] Appl. No.: 568,480

[22] Filed: Dec. 7, 1995

[30] Foreign Application Priority Data

Dec. 8, 1994 [JP] Japan ..... 6-304717
May 1, 1995 [JP] Japan ..... 7-107320

[51] Int. Cl.[6] ..... B02C 19/06

[52] U.S. Cl. ..... 241/39; 241/40

[58] Field of Search ..... 241/5, 39, 40

[56] References Cited

U.S. PATENT DOCUMENTS 3,614,000 10/1971 Blythe ..... 241/5
3,688,991 9/1972 Andrews ..... 241/5
3,837,583 9/1974 Kugelberg et al. ..... 241/39
4,592,302 6/1986 Motoyama et al. ..... 241/5 X
5,016,283 5/1991 Kato et al. ..... 241/5
5,421,524 6/1995 Haddow ..... 241/5
5,447,275 9/1995 Goka et al. ..... 241/5
5,577,670 11/1996 Omata et al. ..... 241/5

FOREIGN PATENT DOCUMENTS 2-111459 4/1990 Japan .

*Primary Examiner*—John M. Husar
*Attorney, Agent, or Firm*—Sidley & Austin

[57] ABSTRACT

A nozzle for connecting between a jet stream spout and a pulverizing room of a jet mill. The nozzle has two nozzle parts. One nozzle part has the shape of a truncated cone with a first cone angle and is located at a jet stream spout side. The other nozzle part has the shape of a truncated cone with a second cone angle different from the first cone angle and is located at a pulverizing room side of the first nozzle part.

20 Claims, 13 Drawing Sheets

4a

4b

4c

NOZZLE FOR JET MILL

BACKGROUND OF THE INVENTION

1. Field of the Invention

This invention relates to a collision type air flow pulverizer (jet mill) that uses a jet air flow to feed, accelerate, and dire material to be pulverized such as toner, against a collision member to pulverize it by means of an impact force.

2. Description of the Related Art

The details of a jet mill are described in reference to FIG. 1. Introducing compressed air into a nozzle that combines a compressed air supply nozzle 2 and a nozzle 3 (referred to as a laval nozzle) produces a rapid supersonic flow inside the nozzle. By injecting material to be pulverized into the nozzle from an inlet a large amount of kinetic energy is transferred to the material to be pulverized. The material to be pulverized, onto which this energy is transferred, is then pulverized by means impact against a collision member 4 provided inside a pulverizing room 5.

FIG. 2 is an enlarged view of the laval nozzle portion of the jet mill shown in FIG. 1. In a conventional jet mill, as shown in FIG. 2, a laval nozzle which has a nozzle cone angle θ that extends from the inlet for the material to be pulverized 1 to a nozzle outlet 7 is identical to the nozzle cone angle that extends from throat portion At to the inlet 1 is used as the nozzle 3. Aerodynamically, in order to realize a rapid supersonic flow in the inlet for the material to be pulverized, a nozzle with this type of laval shape is necessary.

Further, it is preferable for the speed of the air current in the nozzle at the position of the inlet for the material to be pulverized to be as large as possible in order to effectively transfer a large kinetic energy to the material to be pulverized.

SUMMARY OF THE INVENTION

This invention was developed taking the above-mentioned conditions into consideration. The purpose of this invention is to provide a nozzle for a jet mill with improved pulverizing performance, which includes preventing the occurrence of shock waves in the pulverizing room 5 from the inlet for the material to be pulverized as well as causing the material to be pulverized on a collision member without greatly reducing the flowrate of introduced compressed air.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

1. First Embodiment

Figure 3:
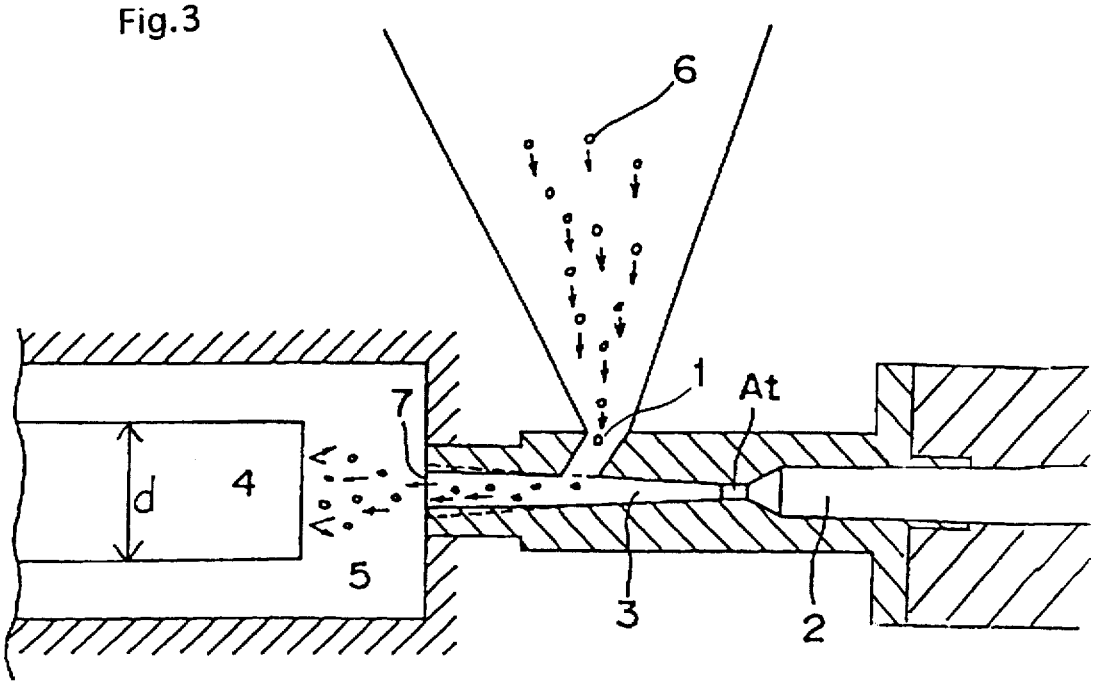
FIG. 3 is an outline cross-sectional view of a jet mill of the first embodiment of the present invention.
Figure 4:
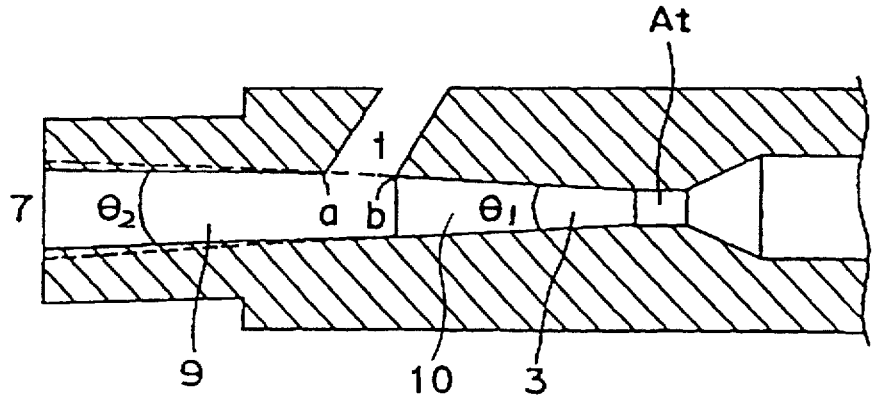
FIG. 4 is an outline cross-sectional view of a nozzle of the first embodiment of the present invention.

The first embodiment of the present invention is described below in reference to the accompanying drawings. FIG. 3 shows an outline cross-sectional view along a longitudinal direction of a jet mill using the nozzle of a first embodiment. Further, FIG. 4 shows an enlarged view of the nozzle of the jet mill shown in FIG. 3.

Compressed air is supplied from a compressed air supply nozzle 2 which is a parallel nozzle. The compressed air passes through a throat portion (cross section At) and is supplied to a nozzle 3. The compressed air supplied to the nozzle 3 changes to a jet air flow inside the nozzle 3. The external shape of the nozzle 3 of this embodiment is cylindrical. As shown in FIG. 4, the nozzle 3 is comprised of a nozzle portion 10 that is a truncated cone-shape and has a cone angle $\theta_1$ in which the compressed air is thermally expanded and the flowrate accelerated as well as a nozzle portion 9 that is a truncated cone-shaped and fulfills the condition $0 \leqq \theta_2 < \theta_1$ for the cone angle $\theta_2$.

Because the nozzle portion 10 is a truncated cone shape having a cone angle $\theta_1$, a sectional area of the hole portion of the pulverizing room 5 side of the nozzle portion 10 is larger than a sectional area of the hole portion of the compressed air supply nozzle 2 side. In like manner, a sectional area of the hole portion of the pulverizing room 5 side of the nozzle portion 9 is larger than a sectional area of the hole portion of the compressed air supply nozzle 2 side.

The material to be pulverized 6 is supplied from the inlet 1 to the nozzle portion 9. The supplied material to be pulverized is accelerated inside the nozzle portion 9, discharged from a nozzle outlet 7 and then collides with the collision member 4 provided inside the pulverizing room 5. The material to be pulverized which collided with the collision member 4 is pulverized by means of an impact force.

The position at which the inlet 1 is provided is a position at which the speed of the air flow inside the nozzle is the maximum in order to apply the maximum amount of kinetic energy to the material to be pulverized. This position where the speed of the air flow inside the nozzle is the maximum is determined by the pressure of the compressed air and the shape of the nozzle.

Although the cross-sectional shape of the nozzle portion 9 of cone angle $\theta_2$ and the nozzle portion 10 of cone angle $\theta_1$ is preferably circular to realize a uniform speed area in all directions, it can also be elliptical. Hereupon, the fact that the flowrate in the area from the inlet 1 to the outlet 7 is not greatly reduced does not mean it will be inevitably reduced by the friction between the material to be pulverized and the tube but means it will be reduced by the extreme pressure loss due to the shape of the nozzle.

When the compressed air thermally expands and accelerates, the cone angle $\theta_1$ of the nozzle portion 10 is 4° to 8° or more preferably, 5° to 7° from the viewpoint of accelerating the compressed air as efficiently as possible. If the cone angle $\theta_2$ of the nozzle portion 9 satisfies the condition $0°<\theta_2<\theta_1$ with respect to the above-mentioned $\theta_1$, although the state is acceptable, more preferably the angle should be 0° (in other words, a parallel nozzle).

Figure 6A:
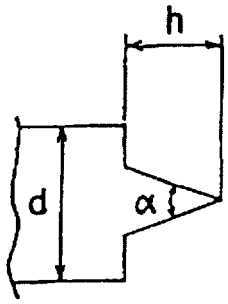
FIGS. 6*a*, 6*b*, and 6*c* are outline cross-sectional views of the various forms of the collision member used in the embodiments of this invention.
Figure 6B:
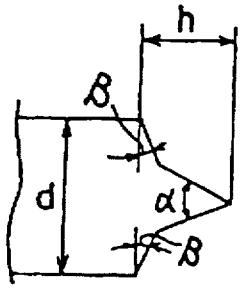
Figure 6C:
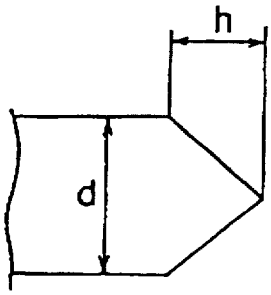

In FIG. 3, although the collision member 4 is stated to be a collision surface having a flat plane shape, it can be shapes 4*a*, 4*b* and 4*c* as shown in FIGS. 6*a*, 6*b*, and 6*c* without any particular restrictions.

The distance from the outlet 7 to the collision member 4 can be freely determined with reference to the target particle diameter of the pulverized particles to be manufactured without any particular restrictions.

By combining the above-mentioned pulverizer of FIG. 3 with a classifier, pulverized particles having a desired particle diameter can be obtained. The classifier (for example, Japan Pneumatic Model DS-5) selects whether the pulverized particles are within the desired particle diameter range.

Figure 5:
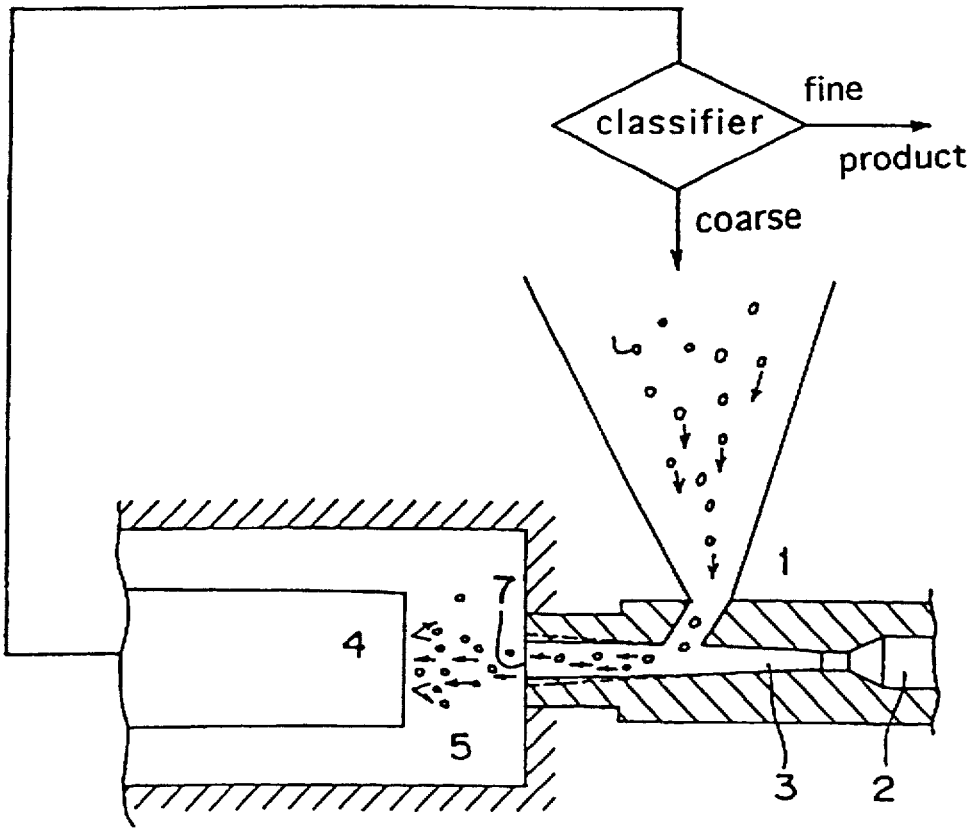
FIG. 5 is a flowchart that combines the jet mill of the present invention and the classifier.

FIG. 5 shows a flowchart of the pulverizing apparatus combining the pulverizing process where the pulverizer is used and the classifier process where the classifier is used.

The pulverized particles exiting from the pulverizing room 5 are sent to the classifier and removed as product having particles within the desired particle diameter range. Then, pulverized particles more coarse than the desired particle diameter range are returned to the pulverizer again to undergo further pulverizing and classification.

Because the pulverizer that uses the nozzle of this embodiment has excellent pulverizing performance, the number of times the pulverizing operation repeats until the desired particle diameter is obtained can be reduced.

A collision type air flow pulverizer (jet mill) is useful when used in a process that finely pulverizes the material to be pulverized (material with a particle diameter of 10 μm to 2000 μm, for example, toner) which was coarsely pulverized by a mechanical type impact pulverizer. This material to be pulverized melts and kneads a mixture containing at least an adhesive resin and a coloring agent and thereafter, the melted and kneaded material is cooled and then pulverized and formed by means of a mechanical type impact pulverizer. The mechanical type impact pulverizer is a device that mechanically applies an impact force to the material to be pulverized to carry out the pulverization. One example of test results for this case is shown below.

Test example 1-1

Preparation of material to be pulverized: Styrene-n-butyl methacrylic resin 100 parts by weight (Tm: 132° C., Tg: 60° C.) Nigrosine dye 5 parts by weight (Nigrosine base EX; Orient Chemical Industries, Ltd) Low molecular weight polypropylene 5 parts by weight (Biscol 550P; Sanyo Transformation Industries, Ltd) Carbon black 10 parts by weight (MA#8; Mitsubishi Kasei Corporation)

The mixture obtained after mixing the above materials in a henschel mixer was kneaded in a continuous extrusion kneader. After cooling the kneaded mixture, it was coarsely pulverized in a hammer crusher and coarsely pulverized particles with an average particle diameter of 2 mm were obtained. The obtained coarse pulverized particles were pulverized in a mechanical type impact pulverizer (Kuriputoron KTMO; Kawasaki Heavy Industries) and material to be pulverized with an average particle diameter of 16 μm to 23 μm was obtained.

A jet pulverizer (IDS-2; Nippon Pneumatic Industries Co., Ltd) was used when further pulverizing the above-mentioned material to be pulverized. For the nozzle during this operation, a conventional nozzle with the shape shown in FIG. 2 that has a cone angle of $\theta_1=6°$ for the nozzle 3 and a nozzle of this embodiment with the shape shown in FIG. 4 that has a cone angle of $\theta_1=6°$ for the nozzle 10 and a cone angle of $\theta_2=0°$ for the nozzle 9 as well as a nozzle with a cone angle of $\theta_2=3°$ was used. Further, the collision member 4 with a flat shape shown in FIG. 3 and the collision members 4, 4*a*, 4*b*, and 4*c* shown in FIGS. 6*a*, 6*b*, and 6*c* were used for each nozzle.

The concrete dimensions of each collision member are as follows.

Collision member 4: d=Φ(diameter) 46 mm

Collision member 4*a*: d=Φ 46 mm, h=25 mm, α=50°

Collision member 4*b*: d=Φ46 mm, h=25 mm, α=50°, β=20°

Collision member 4*c*: d=Φ 46 mm, h=25 mm

The pulverizing conditions used included a feed rate (amount of material to be pulverized introduced into the pulverizer per time unit) of 2 Kg/h, and a pulverizing pressure (pressure of compressed air) of 65 Kgf/cm$^2$ G as well as particle diameters of the material to be pulverized of 16 μm and 23 μm for each of the above-mentioned collision members to carry out the pulverizing.

The pulverizing performance was evaluated by removing the classifier from the jet pulverizer and examining the particle diameter of the pulverized particles obtained by passing the material to be pulverized with particle diameters of 16 μm and 23 μm through the jet pulverizer.

Figure 7A:
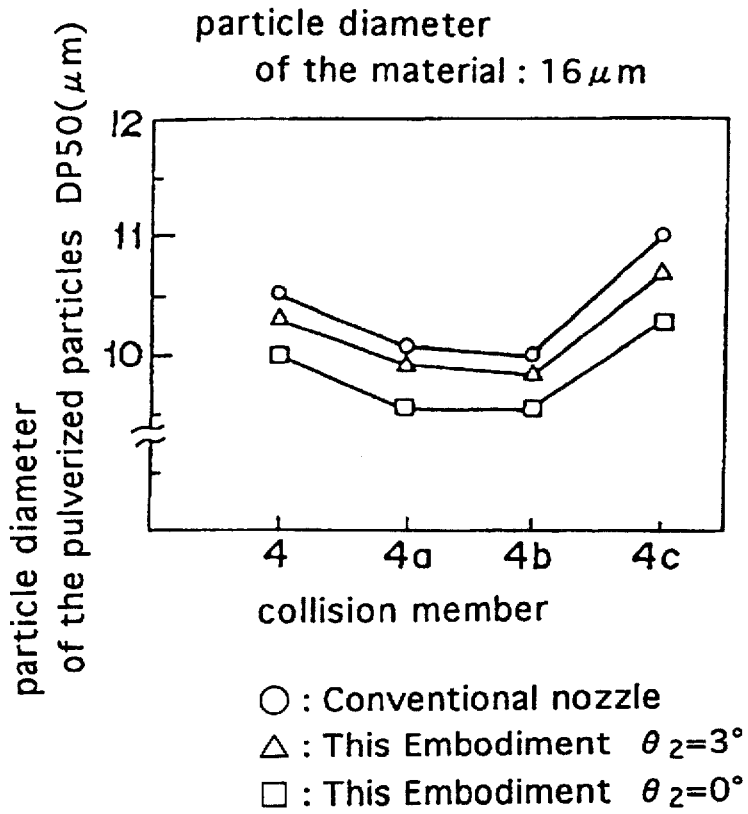
FIGS. 7*a* and 7*b* are graphs showing the evaluation results of the pulverizing performance of the jet mill of the first embodiment of this invention.
Figure 7B:
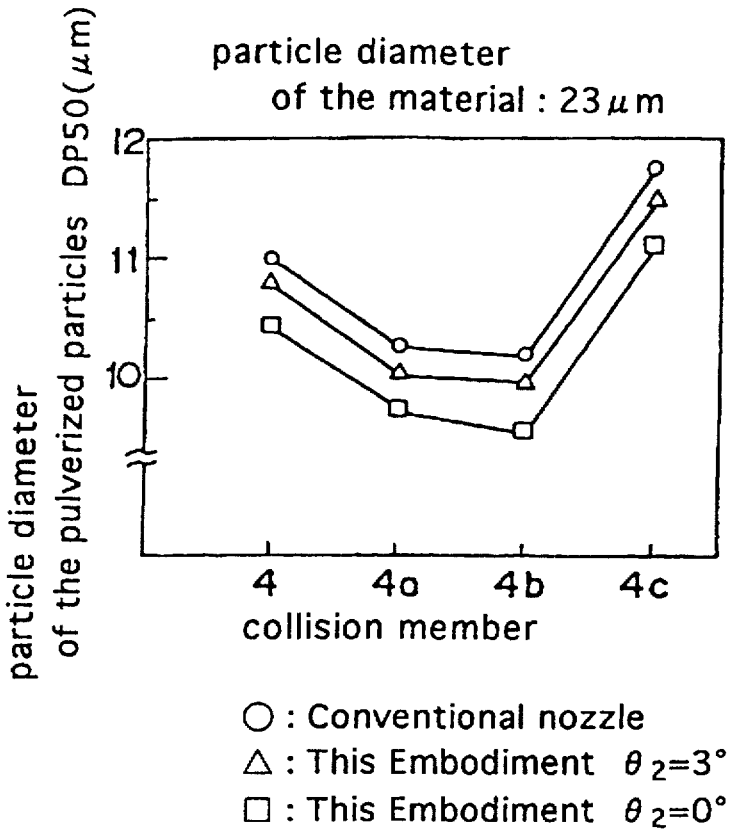

FIGS. 7*a* and 7*b* show the results. From FIGS. 7*a* and 7*b*, it can be seen that the nozzles of this embodiment had an improved pulverizing performance of about 10% at a cone angle of $\theta_2=0°$ and about 5% at a cone angle of $\theta_2=3°$ for the nozzle portion 9 when compared to a conventional nozzle.

Further, the ordinate in FIGS. 7*a* and 7*b* show the particle diameter of the pulverized particles after the material to be pulverized passed through the jet pulverizer once. Dp50 means the particle diameter (namely, the particle diameter of which the weight from the pulverized particles with small particle diameters accumulates and reaches 50% of the entire weight) equivalent to 50% of the distribution when the particle diameter distribution of the pulverized particles are represented by a weight distribution.

Figure 8:
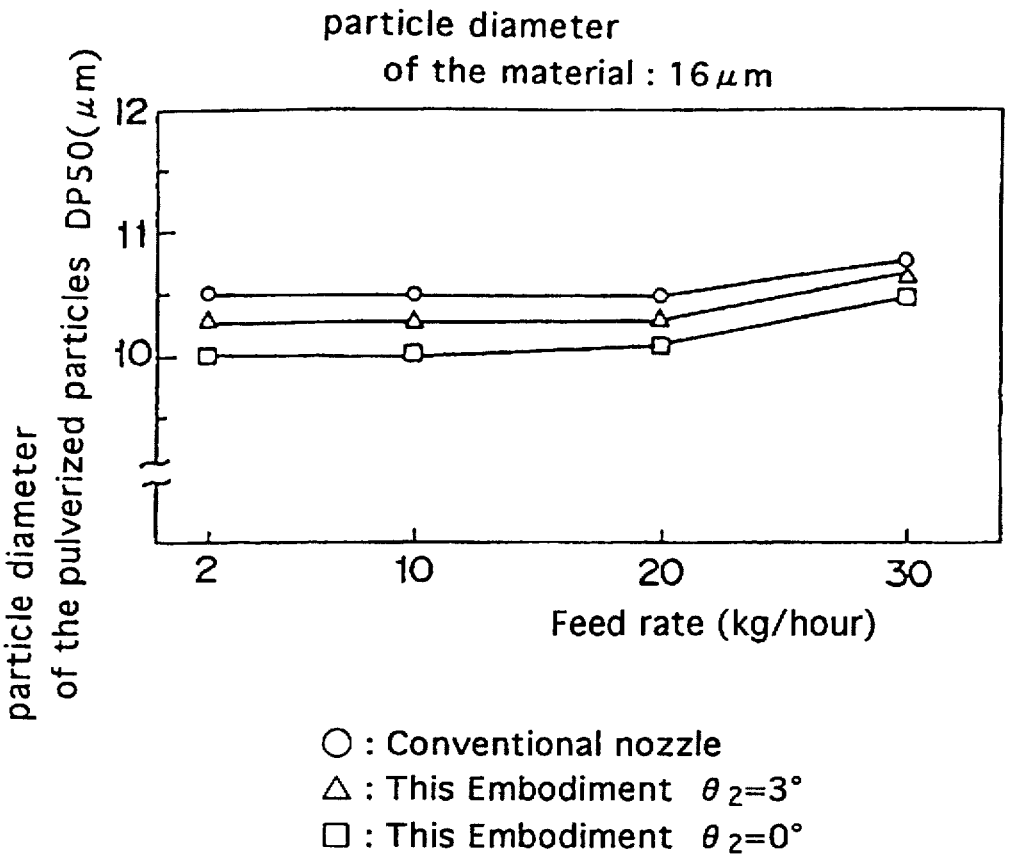
FIG. 8 is a graph showing the evaluation results of the pulverizing performance of the jet mill of the first embodiment of this invention.

The pulverizing performance when the feed rate was changed from 2 Kg/h to 30 Kg/h was further evaluated. The other pulverizing conditions at this time used a collision member 4 as the collision member, fixed the pulverizing pressure at 6.5 Kgf/cm$^2$ G and used particles with a particle diameter of 16 μm as the material to be pulverized. FIG. 8 shows the results. As can be understood from FIG. 8, if the feed rate is within this range, the nozzle of this embodiment has improved pulverizing performance when compared to a conventional nozzle.

Figure 9:
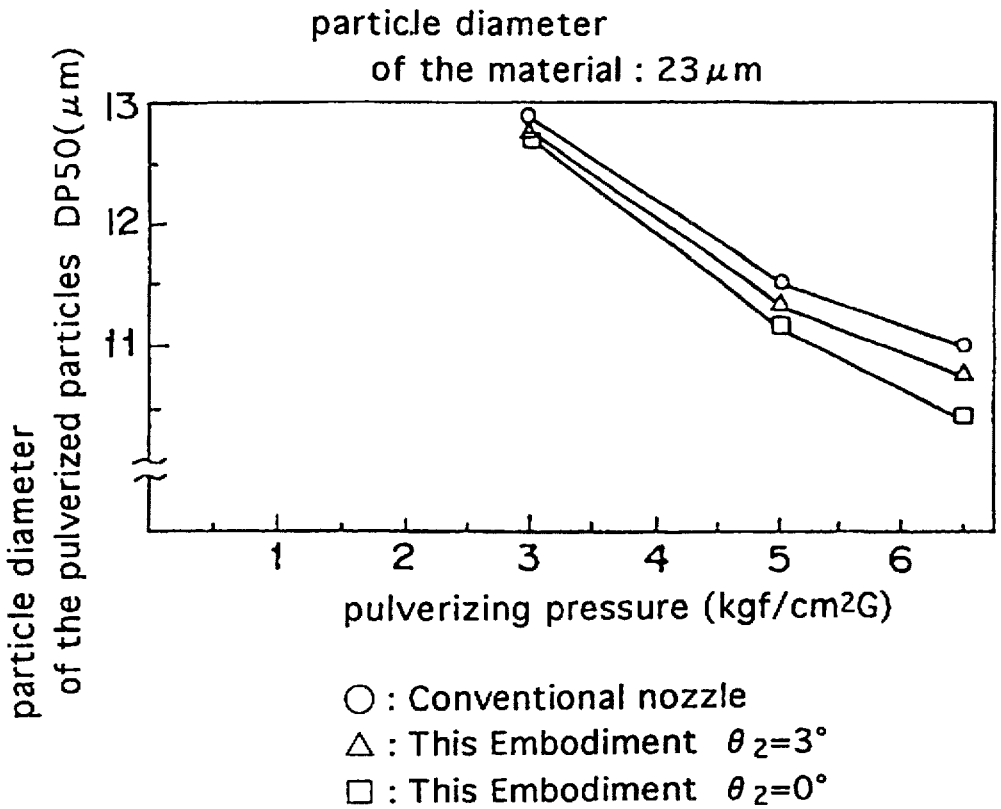
FIG. 9 is a graph showing the evaluation results of the pulverizing performance of the jet mill of the first embodiment of this invention.

The pulverizing performance when the pulverizing pressure was changed to 3 Kgf/cm$^2$ G was further evaluated. The other pulverizing conditions at this time used a collision member 4 as the collision member, fixed the feed rate to 10 Kg/h and used particles with an average particle diameter of 23 μm as the material to be pulverized. FIG. 9 shows the results. As can be understood from FIG. 9, if the pulverizing pressure is within this range, the nozzle of this embodiment has improved pulverizing performance when compared to a conventional nozzle.

Next, one example of test results showing the effects of improvements in the processing performance of this embodiment will be shown.

Test example 1-2

.The material to be pulverized used was the same as that used in test example 1-1.

The process was carried out following the pulverizing flowchart of FIG. 5 using a jet mill pulverizer (I-5; Nippon Pneumatic Industries Co., Ltd) when further pulverizing this material to be pulverized and combining this jet pulverizer with a classifier (DS-5; Nippon Pneumatic Industries Co., Ltd) to obtain the desired particle diameter.

Figure 1:
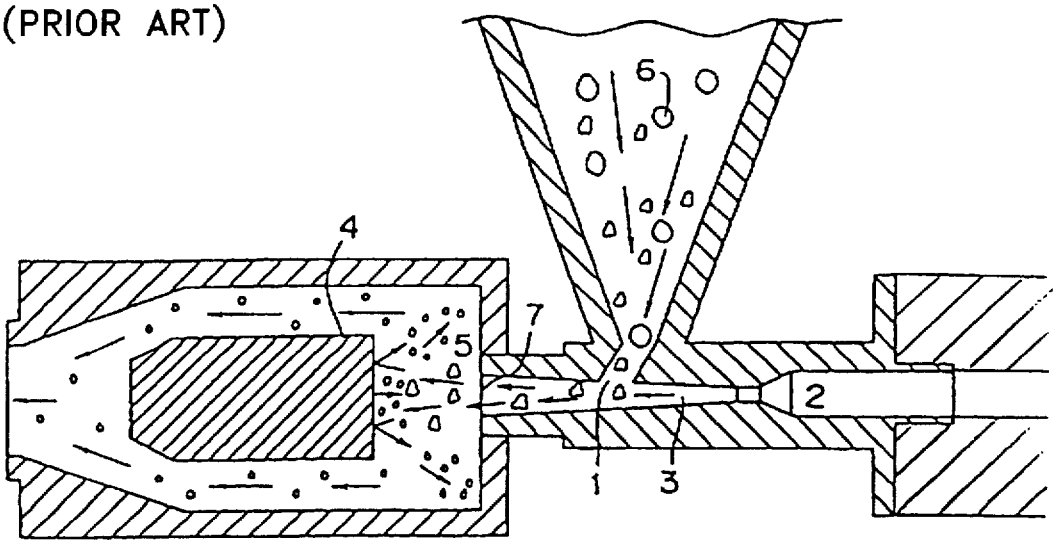
Fig.1 (PRIOR ART)
FIG. 1 is an outline cross-sectional view of a conventional jet mill.
Figure 2:
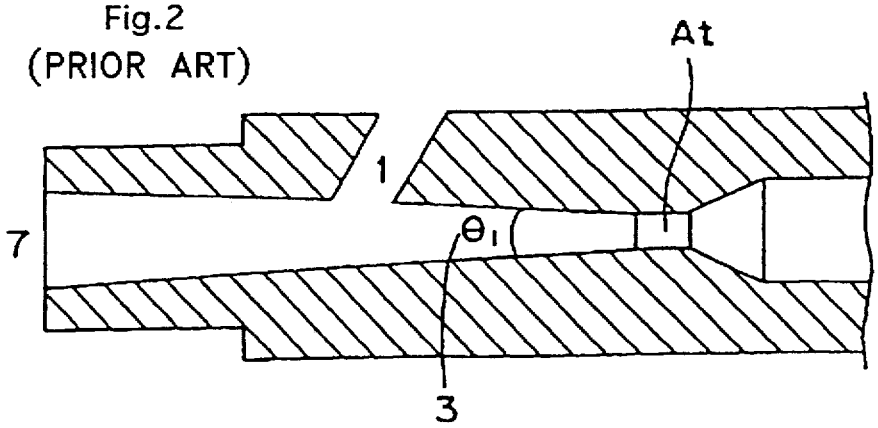
Fig.2 (PRIOR ART)
FIG. 2 is an outline cross-sectional view of a conventional nozzle.

For the nozzle during this operation, a conventional nozzle with the shape shown in FIG. 2 that has a cone angle of $\theta_1$=6° for the nozzle 3 and a nozzle of this embodiment with the shape shown in FIG. 4 that has a cone angle of $\theta_1$=6° for the nozzle portion 10 and a cone angle of $\theta_2$=0° for the nozzle portion 9 were used. Further, the collision member 4 with a flat shape shown in FIG. 3 was used.

The process performance was evaluated by examining the feed rate of the particles when the particle diameter of the pulverized particles after pulverizing were made to become 12 to 14 μm or in other words, when the classification conditions were fixed.

Table 1 shows the results. From Table 1 it can be seen that the nozzle of this embodiment ($\theta_2$=0°) had an improved pulverizing performance of about 20% when compared to a conventional nozzle.

TABLE 1

| | Feed rate (Kg/hour) | |
|---|---|---|
| Desired particle diameter | 12 μm | 14 μm |
| Conventional | 40 (Kg/h) | 50 (Kg/h) |
| First embodiment $\theta_2$ = 0° | 50 (Kg/h) | 60 (Kg/h) |

In other words, when pulverized particles with a desired particle diameter are required, the nozzle of this embodiment can obtain a large amount of pulverized particles in a short time compared to a conventional nozzle.

2. Second Embodiment

Figure 10:
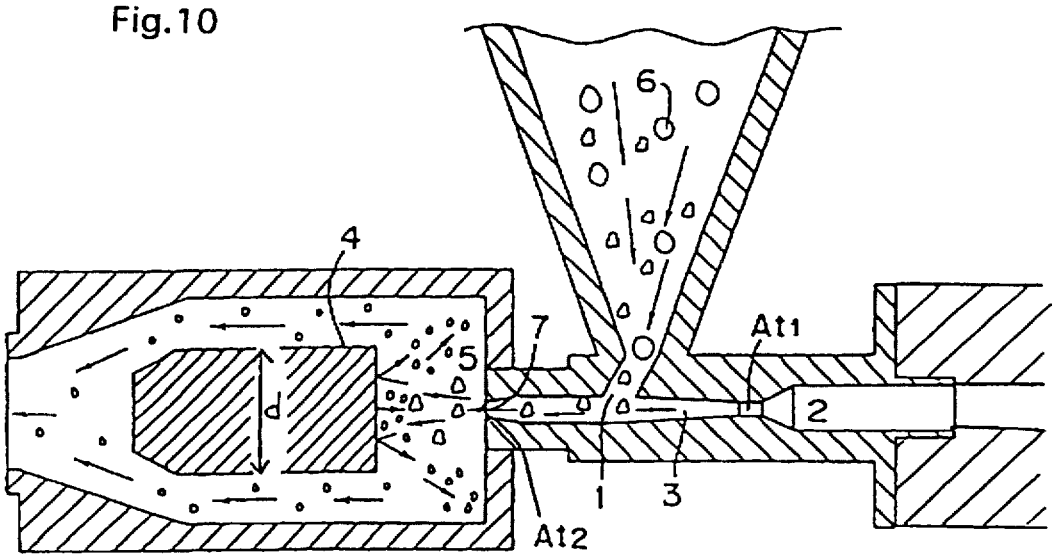
FIG. 10 is an outline cross-sectional view of the jet mill of the second embodiment of this invention.
Figure 11:
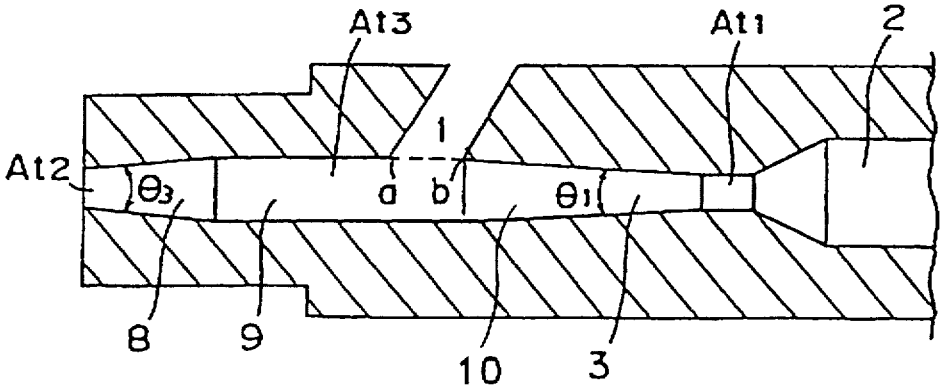
FIG. 11 is an outline cross-sectional view of the nozzle of the second embodiment of this invention.

The second embodiment of this invention is described below referring to the accompanying drawings. FIG. 10 shows an outline cross-sectional view of the jet mill using the nozzle of this embodiment. Further, FIG. 11 shows an enlarged view of a portion of the nozzle of the jet mill shown in FIG. 10. Descriptions identical to the first embodiment are not described.

As shown in FIG. 11 the nozzle 3 of the second embodiment is comprised by a nozzle portion 10 that has a truncated cone shape and a cone angle $\theta_1$ in which the compressed air is thermally expanded and the flowrate accelerated, a parallel nozzle portion 9 having a fixed sectional area (i.e., circular cylinder shape) that fixes the flowrate, and a narrow tip nozzle portion 8 that has a truncated cone shape and a cone angle $\theta_3$ that does not generate a shock wave but gradually reduces the flowrate. Because the nozzle portion 10 is a truncated cone shape having a cone angle $\theta_1$, a sectional area of the pulverizing room 5 side of the nozzle portion 10 is larger than a sectional area of the compressed air supply nozzle 2 side. Furthermore, because the narrow tip nozzle portion 8 is a truncated cone shape having a focusing angle $\theta_3$, a sectional area of the pulverizing room 5 side of the narrow tip nozzle portion 8 is smaller than a sectional area of the compressed air supply nozzle 2 side.

The parallel nozzle portion 9 is a portion extending from the inlet 1 to the narrow tip nozzle portion 8. The length of this parallel nozzle portion 9 is set to the length required to sufficiently accelerate the material to be, uniformly scatter such material within the air flow, and increase the pulverizing characteristics as much as possible by balancing the degree the flow rate decreases due to friction between the air flow and the tube.

The narrow tip nozzle portion 8 can extend from the trailing edge of the parallel nozzle portion 9 to the second throat portion $A_{r2}$ (nozzle outlet) of the nozzle leading edge that reaches the pulverizing room 5. The length of nozzle portion 8 is determined by a cone angle $\theta_3$ that does not allow the material to be pulverized to collide with the walls of the tube, said cone angle $\theta_3$ being within a range that does not allow the sectional area of the second throat portion $A_{r2}$ to be smaller than the first throat portion $A_{r1}$ to increase the pulverizing characteristics as much as possible. The sectional area $A_{r3}$ of the parallel nozzle portion 9 at this time is larger than $A_{r2}$ and has a relationship of $A_{r1}<A_{r2}<A_{r3}$. Moreover, the sectional area of the second throat portion $A_{r2}$ is equal to the sectional area of the pulverizing room 5 side of the narrow tip nozzle portion 8. Even further, the sectional area of the first throat portion $A_{r1}$ is equal to the sectional area of the compressed air supply nozzle 2 side.

The cone angle $\theta_1$ of the nozzle portion 10 is 4° to 8° or more preferably, 5° to 7° from the viewpoint of accelerating the compressed air as efficiently as possible, when the compressed air thermally expands and accelerates. If the parallel nozzle portion 9 is at a level where the flowrate is almost constant, there is no problem slightly shifting its position from parallel and, in like manner to the first embodiment, if the cone angle is smaller than the cone angle $\theta_1$ of the nozzle portion 10, the nozzle can also have a cone angle.

The distance from the outlet 7 to the collision member 4 can be freely changed with reference to the target particle diameter of the particle bodies to be manufactured without any particular restrictions.

Further, without using a parallel nozzle portion 9, the nozzle 3 can be comprised by a nozzle portion 10 with an appropriate length so shock waves do not occur and a narrow tip nozzle portion 8. For this case, the inlet 1 is provided in the middle of the nozzle portion 10.

A pulverization test example like the first embodiment is described below.

Test example 2-1

At first, the material to be pulverized was prepared under the same conditions as test example 1-1.

Furthermore, the size of the material to be pulverized is an average particle diameter of 14 μm to 23 μm. For the nozzle of this embodiment with the shape shown in FIG. 11, a narrow tip nozzle portion 8 with a cone angle $\theta_3$=8°, $A_{r1}$=26.42 mm$^2$, and $A_{r2}$=38.48 mm$^2$ as well as a parallel nozzle portion 9 with a sectional area of 75.43 mm$^2$ were used. The pulverizing conditions included a feed rate of 2 Kg/h, a pulverizing pressure of 65 Kgf/cm$^2$ G as well as particle diameters of the material to be pulverized of 14 μm and 20 μm for each of the collision members to carry out the pulverizing.

The pulverizing performance was evaluated by removing the classifier from the jet pulverizer and examining the particle diameter of the pulverized particles obtained by passing the material to be pulverized with particle diameters of 14 μm and 20 μm through the jet pulverizer once.

Figure 12A:
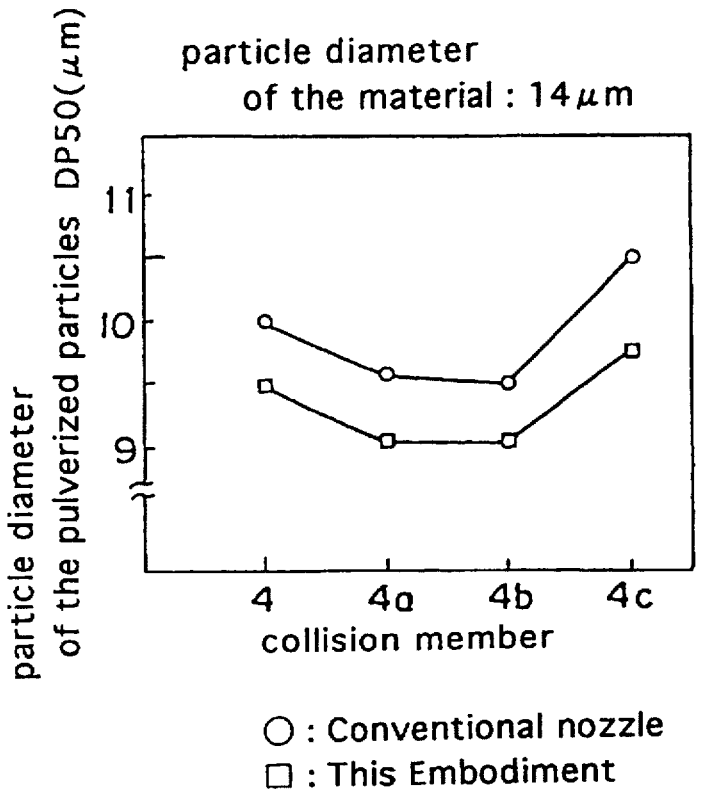
FIGS. 12*a* and 12*b* are graphs showing the evaluation results of the pulverizing performance of the jet mill of the second embodiment of this invention.
Figure 12B:
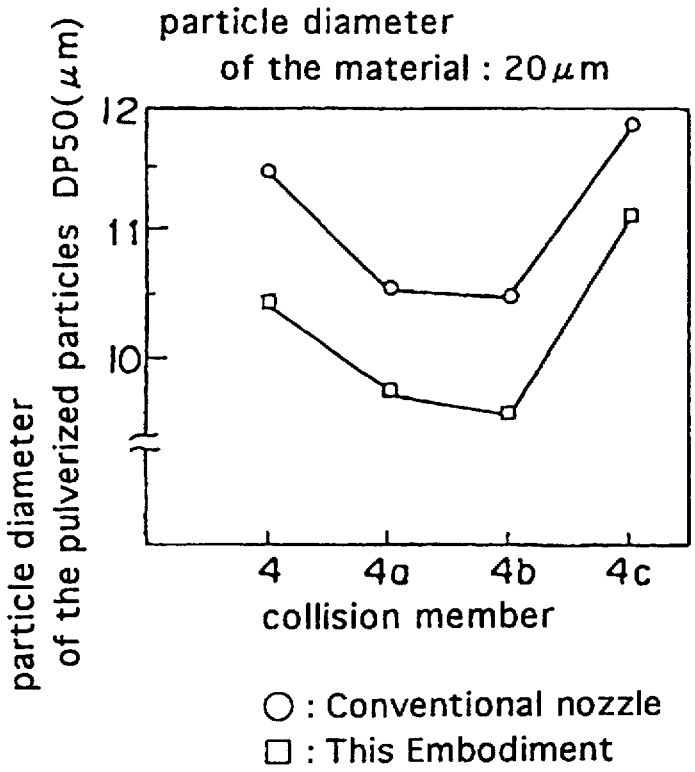

FIGS. 12*a* and 12*b* show the results. From FIGS. 12*a* and 12*b* it can be seen that the nozzle of this embodiment had an improved pulverizing performance of about 10% when compared to a conventional nozzle.

Figure 13:
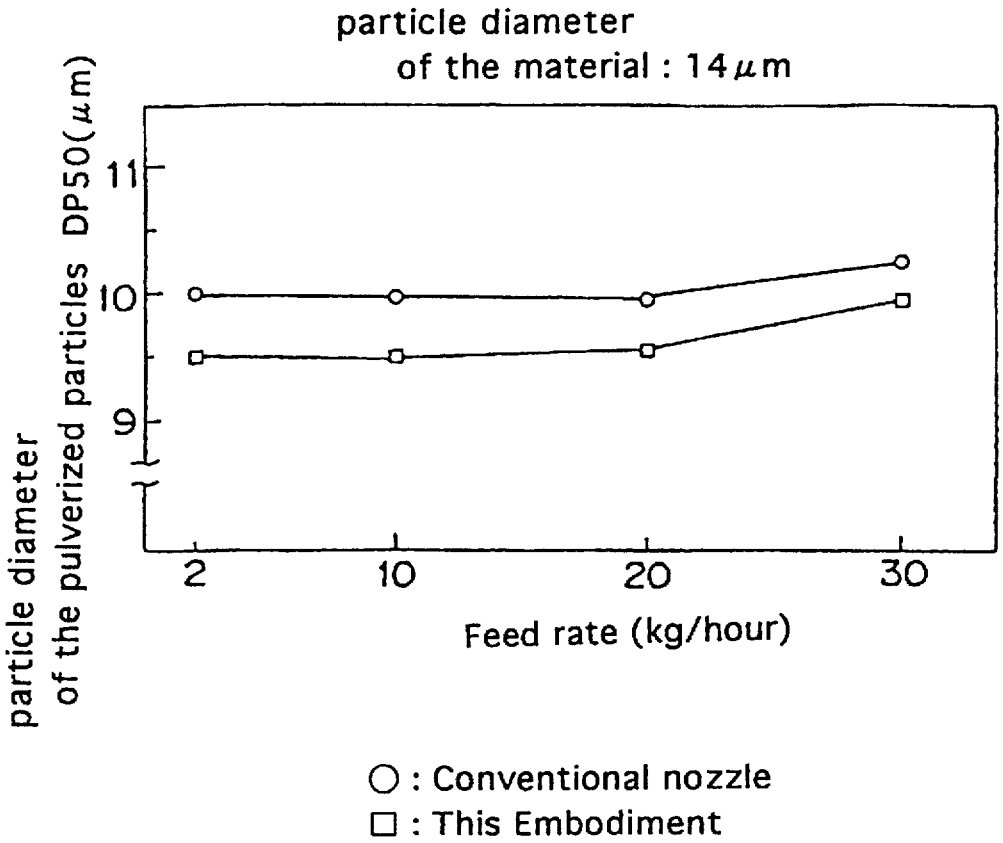
FIG. 13 is a graph showing the evaluation results of the pulverizing performance of the jet mill of the second embodiment of this invention.

The pulverizing performance when the feed rate was changed from 2 Kg/h to 30 Kg/h was further evaluated. The other pulverizing conditions at this time used a collision member 4 as the collision member, fixed the pulverizing pressure to 6.5 Kgf/cm$^2$ G and used particles with an average particle diameter of 14 μm as the material to be pulverized. FIG. 13 shows the results. As can be understood from FIG. 13, if the feed rate is within this range, the nozzle of this embodiment has improved pulverizing performance when compared to a conventional nozzle.

Figure 14:
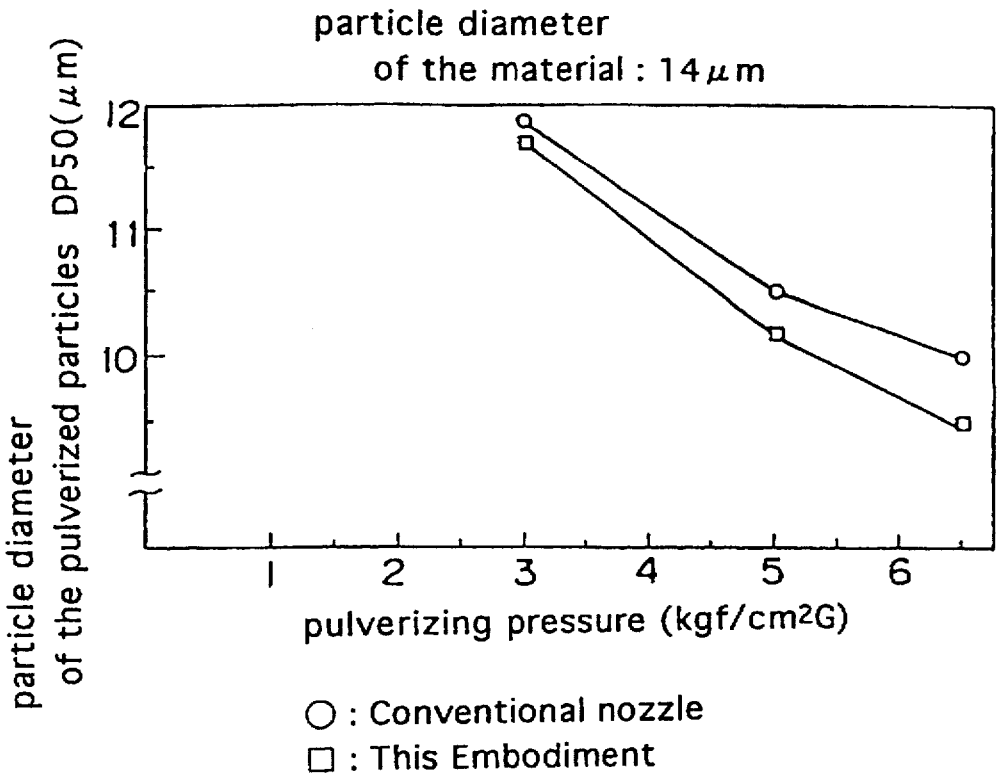
FIG. 14 is a graph showing the evaluation results of the pulverizing performance of the jet mill of the second embodiment of this invention.

The pulverizing performance when the pulverizing pressure was changed from 3 Kgf/cm$^2$ G to 6.5 Kgf/cm$^2$ G was further evaluated. The other pulverizing conditions at this time used a collision member 4 as the collision member, fixed the feed rate to 10 Kg/h and used particles with a particle diameter of 14 μm as the material to be pulverized. FIG. 14 shows the results. As can be understood from FIG. 14, if the pulverizing pressure is within this range, the nozzle of this embodiment has improved pulverizing performance when compared to a conventional nozzle.

Next, one example of test results showing the effects of improvements in the processing performance of this embodiment will be shown.

Test example 2-2

For the nozzle of this embodiment shown in FIG. 11, a leading edge portion (narrow tip nozzle portion 8) of a parallel nozzle with a focusing angle $\theta_3$=8°, $A_{r1}$=62.2 mm$^2$, and $A_{r2}$=90.6 mm$^2$ as well as a parallel nozzle portion 9 with a sectional area of 175.6 mm$^2$ were used.

Furthermore, for the collision member, the collision member 4 (Φ 58 mm) shown in FIG. 10 was used. The other conditions are the same as test example 1-2.

Table 2 shows the results. From Table 2 it can be seen that the nozzle of this embodiment had an improved pulverizing performance of about 15% when compared to a conventional nozzle.

TABLE 2

| | Feed rate(Kg/hour) | |
|---|---|---|
| Desired particle diameter | 12 μm | 14 μm |
| Conventional | 40 (Kg/h) | 50 (Kg/h) |
| Second embodiment | 53 (Kg/h) | 65 (Kg/h) |

In other words, when pulverized particles with a desired particle diameter are required, the nozzle of this embodiment can obtain a large amount of pulverized particles in a short time compared to a conventional nozzle.

By using the nozzle of this invention, the air flow can flow without generating a shock wave in the nozzle and without a large energy loss thereby, allowing the kinetic energy held by the pulverized material during pulverization to be increased more than a conventional jet mill. Consequently, an even greater pulverizing performance can be provided. Further, this greater pulverizing performance can also reduce the number of times the pulverizing operation repeats until the desired particle diameter is obtained in a pulverizing apparatus that combines this pulverizing process and classification process improving the processing performance of the pulverized particles.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A nozzle for connecting between a jet stream spout and a pulverizing room of a jet mill, said nozzle comprising:

a fluid inlet part for operatively interfacing with said jet stream spout;

a first expansion nozzle part which has the shape of a truncated cone with a first cone angle, said first nozzle part following said fluid inlet part; and a second expansion nozzle part which has the shape of a truncated cone with a second cone angle different from the first cone angle, said second nozzle part following said first nozzle part with a non-converging transition positioned between said first nozzle part and said second nozzle part.

2. The nozzle as claimed in claim 1, wherein a sectional area at a pulverizing room side of the first nozzle part is larger than that at a jet stream spout side of the first nozzle part, a sectional area at a pulverizing room side of the second nozzle part is larger than that at a jet stream spout side of the second nozzle part, a sectional area of the non-converging transition is the same as the sectional area at the pulverizing room side of the first nozzle part, and the sectional area at the pulverizing room side of the first nozzle part is the same as the sectional area of the jet stream spout side of the second nozzle part.

3. The nozzle as claimed in claim 2, wherein the cone angles fulfill the following condition;

$$0 \leqq \theta_2 < \theta_1$$

wherein $\theta_1$: first cone angle; and $\theta_2$: second cone angle.

4. The nozzle as claimed in claim 2, further comprising:

a third nozzle part which has the shape of a truncated cone, said third nozzle part following said second nozzle part.

5. The nozzle as claimed in claim 4, wherein a sectional area at a pulverizing room side of the third nozzle part is smaller than that at a jet stream spout side of the third nozzle part.

6. The nozzle as claimed in claim 2, wherein a section of at least one of the first nozzle part or the second nozzle part is elliptical.

7. The nozzle as claimed in claim 2, further comprising:

a material inlet through which material to be pulverized is introduced;

and wherein the first nozzle part is located at a jet stream spout side of the material inlet, and the second nozzle part is located at a pulverizing room side of the material inlet.

8. A nozzle, having a fluid inlet, for connecting between a jet stream spout and a pulverizing room of a jet mill, the nozzle comprising:

a first expansion nozzle part which has the shape of a truncated cone, said first nozzle part following said fluid inlet;

a second nozzle part which has the shape of a circular cylinder, said second nozzle part following the first nozzle part, wherein a first non-converging transition is positioned between the first nozzle part and the second nozzle part; and a third nozzle part which has the shape of a truncated cone, said third nozzle part following said second nozzle part, wherein a second non-converging transition is positioned between the second nozzle part and the third nozzle part.

9. The nozzle as claimed in claim 8, wherein a sectional area at a pulverizing room side of the first nozzle part is larger than that at a jet stream spout side of the first nozzle part, a sectional area at a jet stream spout side of the third nozzle part is larger than that at a pulverizing room side of the third nozzle part, a sectional area of the first non-converging transition is the same as the sectional area at the pulverizing room side of the first nozzle part, and a sectional area of the second non-converging transition is the same as the jet stream spout side of the third nozzle part.

10. The nozzle as claimed in claim 9, wherein the sectional areas fulfil the following condition:

$A_{t1}<A_{t2}$ wherein, $At_{t1}$: the sectional area at the jet stream spout side of the first nozzle part; and $A_{t2}$: the sectional area at the pulverizing room side of the third nozzle part.

11. The nozzle as claimed in claim 9, wherein the sectional areas fulfil the following conditions:

$A_{t2}<A_{t3}$ wherein, $A_{t2}$: the sectional area at the pulverizing room side of the third nozzle part; and $A_{t3}$: the sectional area of the second nozzle part.

12. The nozzle as claimed in claim 9, wherein a section of at least one of the first nozzle part, the second nozzle part, or the third nozzle part is elliptical.

13. The nozzle as claimed in claim 9, further comprising:

a material inlet through which material to be pulverized is introduced;

and wherein the first nozzle part is located at a jet stream spout side of the material inlet, and the second nozzle part is located at a pulverizing room side of the material inlet.

14. A nozzle, having a fluid inlet part, for connecting between a jet stream spout and a pulverizing room of a jet mill, said nozzle comprising:

a first expansion nozzle part which has the shape of a truncated cone, said first nozzle part following said fluid inlet part; and a second nozzle part which has the shape of a circular cylinder, said second nozzle part following said first nozzle part, wherein a non-converging transition is positioned between said first nozzle part and said second nozzle part.

15. The nozzle as claimed in claim 14, wherein a sectional area at a pulverizing room side of the first nozzle part is larger than that at a jet stream spout side of the first nozzle part, a sectional area of the non-converging transition is the same as the sectional area at the pulverizing room side of the first nozzle part, and the sectional area at the pulverizing room side of the first nozzle part is the same as the sectional area of a jet stream spout side of the second nozzle part.

16. The nozzle as claimed in claim 15, wherein a section of at least one of the first nozzle part or the second nozzle part has the shape of an ellipse.

17. The nozzle as claimed in claim 15, further comprising:

a material inlet through which material to be pulverized is introduced;

and wherein the first nozzle part is located at a jet stream spout side of the material inlet, and the second nozzle part is located at a pulverizing room side of the material inlet.

18. A pulverizing apparatus comprising:

a pulverizing room;

a collision member provided in the pulverizing room;

a nozzle outlet provided within a wall of the pulverizing room;

a nozzle portion connected with the nozzle outlet, said nozzle portion comprising:

an air supply device to supply an air stream from the nozzle portion to the pulverizing room;

a first expansion nozzle part which has the shape of a truncated cone with a first cone angle;

a second nozzle part which is positioned between and connected to the first expansion nozzle part and the nozzle outlet, said second nozzle part has a second cone angle which is less than the first cone angle; and a material inlet positioned between and connected to the first expansion nozzle part and the second nozzle part for introducing a material supplied through the material inlet into the air stream, said supplied material being accelerated inside the second nozzle part, being discharged from the nozzle outlet, and colliding with the collision member to pulverize the supplied material.

19. The pulverizing apparatus as claimed in claim 18, wherein the second nozzle part has a circular cylinder.

20. The pulverizing apparatus as claimed in claim 19, wherein the second nozzle part has the circular cylinder and a compression nozzle portion which is connected with the nozzle outlet.

* * * * *